US005112248A

United States Patent [19]

Kibblewhite et al.

[11] Patent Number: 5,112,248

[45] Date of Patent: May 12, 1992

[54] ELECTRICAL CONTACT MECHANISM FOR ULTRASONIC TRANSDUCERS ON FASTENERS

[75] Inventors: Ian E. Kibblewhite, Ambler; Robert H. Strunk, Philadelphia, both of Pa.

[73] Assignee: SPS Technologies, Inc., Newtown, Pa.

[21] Appl. No.: 699,532

[22] Filed: May 14, 1991

Related U.S. Application Data

[62] Division of Ser. No. 616,513, Nov. 21, 1990, abandoned, which is a division of Ser. No. 419,053, Oct. 10, 1989, Pat. No. 5,018,988.

[51] Int. Cl.[5] ..... H01R 3/00; H01R 17/04

[52] U.S. Cl. ..... 439/577; 439/13; 73/761

[58] Field of Search ..... 73/761; 439/13, 20-23, 439/482, 577, 675, 824, 894, 912

[56] References Cited

U.S. PATENT DOCUMENTS

| | | | |
|---|---|---|---|
| 2,485,881 | 10/1949 | Helin | 439/482 |
| 3,759,090 | 9/1973 | McFaul et al. | 73/67.6 |
| 3,969,960 | 7/1976 | Pagano | 73/761 |
| 4,014,208 | 3/1977 | Moore et al. | 73/67.9 |
| 4,127,788 | 11/1978 | Daugherty | 310/328 |
| 4,294,122 | 10/1981 | Couchman | 73/761 |
| 4,295,377 | 10/1981 | Couchman | 73/761 |
| 4,676,109 | 6/1987 | Wallace | 73/761 |
| 4,686,859 | 8/1987 | Wallace | 73/761 |
| 4,760,740 | 8/1988 | Meisterling | 73/761 |
| 4,846,001 | 7/1989 | Kibblewhite | 73/761 |

OTHER PUBLICATIONS

IBM Technical Disclosure Bulletin, "A Coaxial Test Probe", vol. 12, No. 7, p. 1061, Dec. 1969.

IBM Technical Disclosure Bulletin, "Tester Contact Method", vol. 21, No. 9, p. 3742, Feb. 1979.

Coda Systems Ltd. product brochure entitled "Unified Range of Spring Contact Test Probes".

Microtech, Inc. Handbook.

*Primary Examiner*—Gary F. Paumen

*Attorney, Agent, or Firm*—James D. Dee; Aaron Nerenberg

[57] ABSTRACT

An electrical contact structure for making and maintaining an electrical connection through a rotatable tool head is provided. A low cost contact probe assembly can be incorporated into the drive of various conventional tightening tools to extend onto the head of a fastener to make and maintain electrical contact therewith while the head is being operated upon by the socket or gripping means of the tightening tool. This contact probe assembly includes an insulated and shielded electrically conductive tube.

4 Claims, 5 Drawing Sheets

ELECTRICAL CONTACT MECHANISM FOR ULTRASONIC TRANSDUCERS ON FASTENERS

This is a divisional of co-pending application Ser. No. 616,513 filed on Nov. 21, 1990, now abandoned, which is a divisional of application Ser. No. 419,053 filed on Oct. 10, 1989, now U.S. Pat. No. 5,018,988.

BACKGROUND OF THE INVENTION

This invention relates to electrical connectors and structures for making electrical connections without lockingly engaging the electrical connection. More specifically, it relates to contact mechanisms for making reliable electrical contact with an ultrasonic transducer mounted in the head, or other end (transducer is on threaded end in some applications) of a fastener, such as a screw or bolt.

Ultrasonics have been used for many years for the detection of cracks and other "faults" in metals and other structural members. Of relatively recent development is the use of ultrasonics for the measurement of the stress applied to a fastener member as a function of the elongation of that fastener as it is tightened against the structure to which it fastens.

Early attempts at this ultrasonic measurement of stress loads introduced into fasteners included McFaul et al., U.S. Pat. No. 3,759,090, who measured fastener elongation with a transducer head manually held against the head of a bolt and interfaced with a glycerin coating used as the acoustic coupling medium. A coaxial cable connected from electronic circuitry was connected to a piezoelectric crystal held in a transducer head assembly.

Like McFaul et al., Moore et al., U.S. Pat. No. 4,014,208, used an ultrasonic transducer held against a bolt head of fastener to make ultrasonic readings. Moore et al. also utilized an acoustic coupling medium such as glycerin. Moore et al., however, placed their transducer within the drive socket of a socket wrench in order to take readings. A hard wired connection, presumable a solder or screw terminal connection, connected the Moore et al. transducer head to their electronic circuitry. Twin lead wire was used.

While both McFaul and Moore could each move their respective ultrasonic transducer heads from one fastener to another, and no modification of a fastener or bolt was needed other than to provide for a flat transducer interface surface, their measurement results were often difficult to repeat and difficult to calibrate because of acoustic losses at the bolt-to-transducer glycerin interface. Moreover, measurements were often affected by an individual technician's manual procedures and by factors such as dust which modified the acoustic coupling interface.

It was desirable, therefore, to implant an ultrasonic transducer, which may be a piezoelectric device, directly and permanently onto a bolt or fastener with a reliable acoustic interface to the fastener. The ultrasonic coupling would, therefore, be repeatably predeterminable at manufacture from fastener to fastener. By doing so, only an electrical connection need be made to the ultrasonic transducer.

Dougherty, U.S. Pat. No. 4,127,788, had provided a bolt having a threaded insert and a threaded cap. A piezoelectric crystal with hard wired electrical connections is embedded in a resin block. This block is secured in mechanical pressure contact within the bolt by tightening the threaded insert against the threaded cap. Electrical connections with the wires extending from the bolt must then be made. This lends to excellent static ultrasonic testing, but eliminates the possibility of ultrasonic testing while tightening the fastener as the wire leads get in the way.

Couchman, U.S. Pat. No. 4,294,122, has focused on the problem of testing in the dynamic state. He has provided a fastener or bolt with a piezoelectric device secured permanently within its end. An electrical contact surface is provided to extend flush with the surface of the end adjacent the piezoelectric device and to be electrically isolated therefrom. A first and second hard wired electrode provides electrical connections between the piezoelectric device and the electrical contact surface and the piezoelectric device and the bolt body, respectively.

Electrical contact to the Couchman fastener embedded piezoelectrical device is made through a spring biased terminal pin carried by a tightening tool and in contact with the bolt end contact surface. The tool is grounded as is the drive socket which is in contact with the bolt body.

Couchman represents an improvement over the other art where reading errors due to a lack of reproducibility of a good acoustic interface between the piezoelectric transducer and the bolt body occurred from unit to unit. By placing an individual piezoelectric transducer in the bolt body, the poor acoustic coupling errors introduced by the manually held transducer head using glycerin are eliminated. Moreover, Couchman has solved the twin lead tangling problems which occurred with Dougherty when the bolt was turned with the wires connected.

However, the Couchman structure presents an opportunity for measurement errors caused by poor electrical connections, i.e., electrical coupling. Couchman relies upon a simple solid probe or pin which is spring biased outwardly from his power wrench socket head. A single electrical line, a spring and the terminal pin extend through a bore or other opening in the power wrench and socket head. During static conditions, an adequate electrical connection may be maintained.

However, during dynamic conditions, i.e., during tightening and especially during high speed assembly, the operation of the power wrench and rotation of the socket head can cause erratic electrical contact between the bolt body and the socket head and between the piezoelectric transducer terminal plate and the electric terminal pin. The Couchman probe pin can bend, rock or break, making readings impossible. It can also jump during rotation, making readings erratic. It is desirable to provide a structure where this does not occur or where its occurrence is greatly reduced. Further, as Couchman relies only upon his drive socket and tool body for his return electrical signal line, grease, dirt and foreign matter on the drive socket, and stray electrical signals from the tool body can interfere with the "sense" readings.

Couchman, U.S. Pat. No. 4,295,377, disclosed a specific rotational coupling that allows the pin to rotate with the fastener. However, it is desirable to provide a structure which eliminates the need for a specific rotational coupling mechanism since it is a recognized problem that the rotation of the fastener relative to the electronics presents a problem in providing reliable electrical contact.

An object of the present invention is to provide an improved electrical contact mechanism for electrically connecting ultrasonic transducers, which have been fixedly mounted on a fastener or bolt with electronic apparatus, while the fastener or bolt is being tightened.

A second object of this invention is to provide an improved electrical contact mechanism which eliminates the need for a specific rotational coupling.

A third object of this invention is to provide such an electrical contact mechanism which can be installed axially into hand wrenches and electrically, pneumatically, or hydraulically powered tightening tools, such as electric spindles, impact wrenches, RANs (right angle unit runners) and other devices.

Another object of this invention is to provide such an electrical contact mechanism which can be installed to extend through a tool socket head and which is capable of maintaining good electrical contact with a contact surface on a bolt head while the bolt is tightened with a tool socket head and which provides a secure twin lead electrical connection.

A further object of this invention is to provide protection of the contact mechanism to secure it from damage during assembly operations, while not interfering with normal operation of the tool and to provide a low cost contact pin which can quickly be replaced.

SUMMARY OF THE INVENTION

The objects of the present invention are realized in an electrical contact structure for connecting the electrical wiring from an electronic control unit, for generating and measuring ultrasonic wave transmission and reflection, and an ultrasonic transducer mounted in the body of a fastener or on a surface thereof.

The ultrasonic transducer, typically mounted in the head or other end of a bolt of fastener, includes an electrical contact surface for signal transmission between the transducer itself and the electronic control unit. The body of the bolt or fastener provides the ground return.

The electrical contact structure of the present invention includes a contact probe assembly which can be incorporated into the drive of a tool used for tightening the fastener. An electrical connection with the transducer contact surface is made when the drive incorporating the contact structure is placed on the head of the fastener. This connection is made through contact of an electrically conductive probe to the transducer electrical contact surface, with the return or "ground" being made through the body of the drive contacting the body of the fastener, and preferably through a structure of a spring loaded shield in mechanical contact with the body of the fastener.

The probe assembly includes an insulated casing which carries an electrically conductive tube structure. An electrically conductive movable pin subassembly is positioned within the conductive tube structure and in electrical contact therewith. This movable pin subassembly carries a contact pin spring biased to the outward position.

The probe assembly can carry a second electrically conductive movable pin subassembly at the other end of the conductive tube structure from the first subassembly. Like the first, this second subassembly carries a contact pin spring biased to the outward position.

In designs where two subassemblies are incorporated, each is fixedly positioned within the conductive tube structure.

A detent structure may be incorporated to assist in position determination of each of the respective pin subassemblies, thereby regulating their extensions outwardly from an end of the conductive tube.

The insulated casing interfere with a prepared cavity in the tool drive. A retractable probe guard is included and assists in additional grounding or common line electrical return as well as to protect the protruding electrical contact pin. This additional grounding or common line return can use parts of the tool drive for a return path. Alternatively, this return path can be made through a dedicated electrical signal conduction structure apart from the body of the tightening tool.

The contact mechanism is installed in a standard tightening tool which has been adapted to receive and hold it. This typically is accomplished by machining a cavity in the tool drive mechanism. In machine assembly tools with offset drive, this adaptation can take the form of a through bore in the drive assembly. The offset gear box in such tools lends itself to the space for making electrical cable connections to the contact mechanism structure.

DESCRIPTION OF THE DRAWINGS

The features, operation and advantages of the present invention will be readily understood from a reading of the following Detailed Description of the Invention in conjunction with the attached drawings in which like numerals refer to like elements and in which.

DETAILED DESCRIPTION OF THE INVENTION

Figure 1:
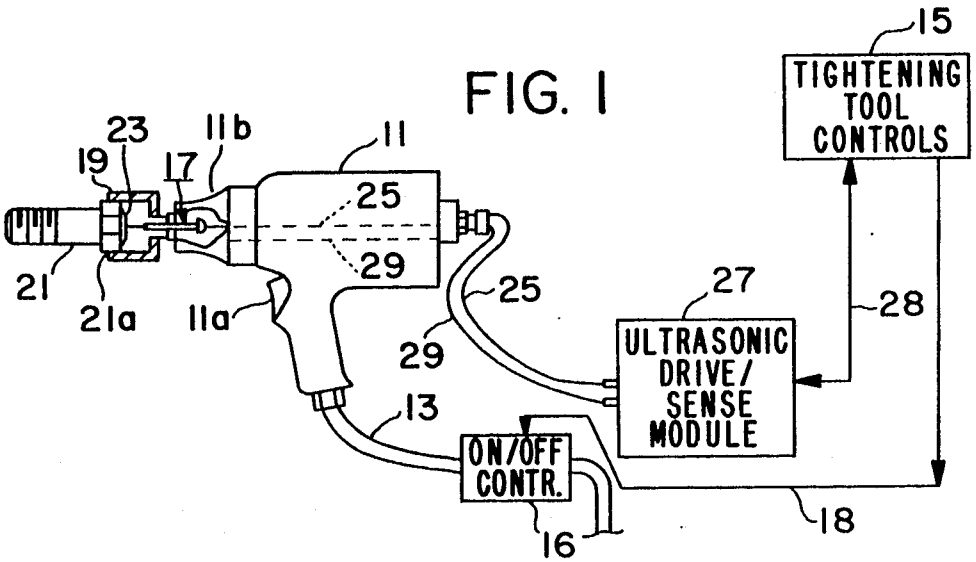
FIG. 1 is a diagram of a hand held power assembly tool such as an impact wrench system utilizing the electrical contact mechanism shown in cutout section and partial cross section.

An electrical contact mechanism for making contact with ultrasonic transducers on fasteners is shown as part of an impact wrench system, FIG. 1. Here, a hand held power assembly tool such as an impact wrench 11 is powered from an air line, or other power source 13. The power in line 13 is controlled by a control unit 15 which comprises controls for operating the tightening tool 11. Although the impact wrench 11 has its own activating trigger 11*a*, the control unit 15 maintains ultimate power to the impact wrench 11. An on/off and speed control device 16 is connected into the power line 13 to the wrench 11 and receives a control signal 18 from the control unit 15.

A contact mechanism 17 is positioned within the drive portion 11*b* of the impact wrench 11. This contact mechanism extends into the drive socket 19, driven by the impact wrench 11. The drive socket 19 engages a fastener 21 which has an ultrasonic transducer mounted in the head portion 21*a* or other end thereof. The contact mechanism 17 provides an electrical contact with a transducer electrical contact surface 23 on the top face of the head portion 21*a* of the fastener.

An electrical signal line 25 makes an electrical connection between an ultrasonic drive/sense module 27 and the contact mechanism 17. A second signal line 29 provides the ground connection between the ultrasonic drive/sense module 27 and the transducer. This second line connection 29 is made through the body of the impact wrench 11, its drive section 11*b* is the drive socket 19 which is in mechanical contact with the head portion 21*a* of the fastener 21. The second lead 29 to the transducer positioned within the head portion 21*a* is made through the body of the fastener 21. The ultrasonic drive/sense module 27 is electronically connected to the tightening tool controls 15 through cabling 28. This enables the sense module 27 to "shutdown" the tightening controls 15 by means of the on/off device 16 when a proper stress load is achieved on the fastener 21.

Figure 2:
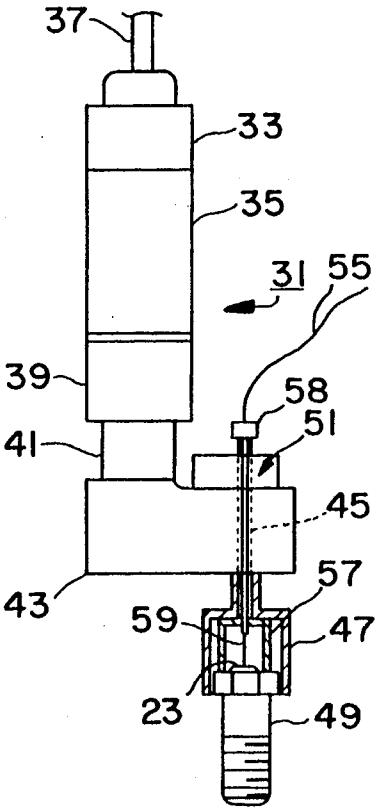
FIG. 2 is a partial cross section showing an offset spindle drive with the embodiment of the electrical contact mechanism in cross section.

The contact mechanism 17 of FIG. 1 may be adapted to an assembly line electric spindle tool 31, FIG. 2. Such a spindle tool 31 has a resolver section 33 on top of a motor section 35. A motor section 35 receives power control signals through cabling 37. It is to be understood that the cabling 37 comes from a control unit so that the electric spindle structure 31 can operate in a system such as shown for the impact wrench 11, FIG. 1. As an alternative, a pneumatic assembly with a solenoid for on/off control could be substituted for this structure. In this instance, the electric motor 35 would receive power directly from the cabling 37.

The electric motor 35, FIG. 2, output is connected to a planetary gearbox 39. The output from this planetary gearbox 39 drives a transducer section 41. This transducer 41 connects the planetary gearbox 39 to an offset gearbox 43.

The offset gearbox 43 includes a drive spindle 45 and a tool drive socket 47 which seats down on a head of a fastener 49. This fastener 49 can be identical to the fastener 21 of FIG. 1. Therefore, the fastener 49 includes an ultrasonic transducer embedded within or on top of its head or other end, as well as a transducer electrical contact surface 23 of the top face of the head.

The offset gearbox 43 in most cases is used to provide additional gearing or enable access to closely spaced bolts. It is used here as a structural support means for getting electrical signal lines to and from the tool drive.

The offset spindle 31, shown in FIG. 2, contains the contact mechanism 51 which embodiment departs from the contact mechanism 17 of FIG. 1. Here, the contact mechanism 51 includes a coaxial connection 53 of its upper end for connecting with coaxial cable 55 connector. The contact mechanism 51 also includes a spring biased cup-shaped shield or skirt 57 about the contact pin 59. This shield 57 opens onto the head of the fastener 49 at a location surrounding the transducer electric contact surface 24 and provides a separate electrical return path which eliminates or reduces the breaking of electrical contact during tightening.

A pin-shaped probe 59 is spring biased downwardly to contact the transducer contact surface 23 when the drive socket 47 is down over the head of the fastener 49. When the structure is in this position, the twin leads of the coaxial cable 55 make connection with the transducer within the head of the fastener 49 through the probe 59 and shield 57. The ground return is made through the body of the drive socket 47 in contact with the body of the fasteners 49, as well as through the electrically conductive shield 57 also in contact with the body of the fastener 49 at a position outside of the contact surface 23.

Figure 3:
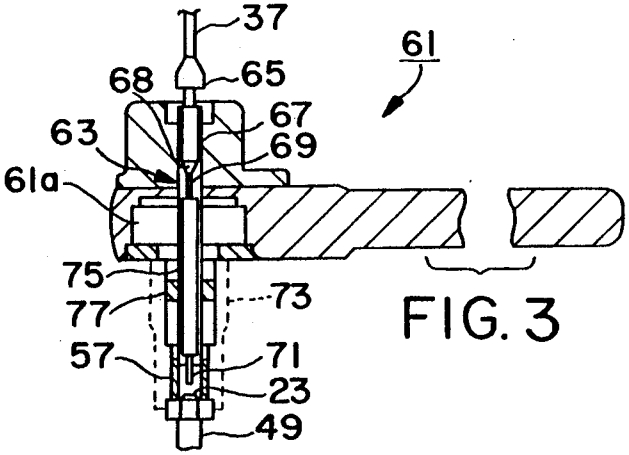
FIG. 3 is a partial cross section of a hand wrench with the embodiment of the electrical contact mechanism in cross section.

As an alternative to the impact wrench 11 of FIG. 1 or the electric spindle assembly 31 of FIG. 2, a hand wrench assembly 61 can be adapted to receive a contact mechanism 63, FIG. 3. In this embodiment, the hand wrench 61 has been modified to receive the contact mechanism 63. Here the contact mechanism 63 extends down the longitudinal center of the drive of the hand wrench 61. A coaxial cable 37 is connected through a Microdot Corp. coaxial connector 65. This connector 65 includes a contact pin extension tube 67. The connector has a pin extending in electrical contact with an upper pin 69 of the electrical contact mechanism 63. The contact pin extension tube 67 forms an assembly 67 which has an internal spring biasing a pin 68. A lower pin 71 extends toward the fastener 49 for making contact with the transducer contact surface 23 when the nut runner drive socket 73, shown in phantom, is lowered down on the head of the fastener 49.

The contact mechanism 63, FIG. 3, includes a shield or skirt 57 which surrounds the lower pin 71. This mechanism 63, which is similar to that previously described, also includes a casing or housing 75. A socket retaining mechanism 77 is also included. From FIG. 3, it can be seen how the hand wrench 61 has been modified, including the adaption of the ratchet gear portion 61*a* at the nut runner head for allowing the positioning of the contact mechanism 63 casing 75 therein.

The contact mechanism of the present invention, discussed in connection with the embodiment above, contacts spring biased movable pin subassemblies at both ends of its inner electrical conductive tube.

Figure 4:
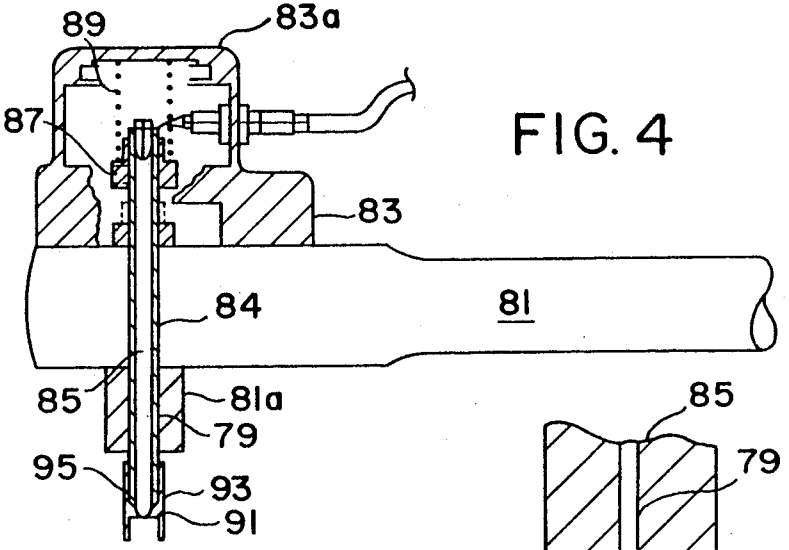
FIG. 4 shows a partial cross section of a hand wrench tool with an alternate embodiment of the electrical contact mechanism in cross section.

An alternate structure for the hand wrench 61 contact mechanism is shown in FIG. 4. Here, hand wrench 81 has had its wrenching drive modified.

FIG. 4 shows the contact mechanism comprising an outer plastic insulating casing 84 fitted to the head of a hand ratchet wrench 81. A ratchet housing 83 of modified design accepts a connection cap portion 83*a*. This casing has an electrical conducting metal inner rod 85 and an electrically conductive outer sleeve 79.

A rod 85 operates within the casing electrically insulated inner bore 84 to slide upwardly and downwardly.

This rod 85 has a boot 87 fitted over the upper end of the rod 85 and containing a shoulder for supporting a biasing spring 89. The biasing spring 89 rests against the inside top face of the connection cap portion 83*a* to operate against the boot 87 and thereby bias it downwardly along with the rod 85.

An electrical contact 91 is carried at the downward end of the rod 85. This electrical contact 91 is intended to make contact with the ultrasonic transducer contact surface 23 on the head of a fastener.

A protective skirt or shield 93 extends about the rod 85 and its contact pin 91. When in operation, a drive socket (not shown) which fits on the tool drive end 81*a*, has a center opening large enough to allow for the passage of the casing 75, rod 85, and protective shield 93. This shield 93 is used to protect the end of the contact pin 91 as well as to provide additional "ground return" electrical connection from the body of a fastener in which it comes in contact.

A separate biasing spring 95 can seat against a foot portion of the shield 93 which causes the shield 93 to be independently biased downwardly and away from the socket wrench drive 81*a*.

Figure 4A:
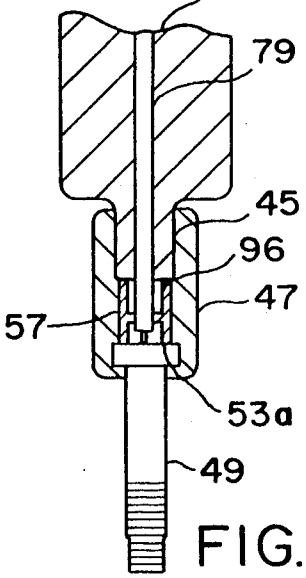
FIG. 4*a* shows a detailed cross section of the lower drive portion of an assembly line tightening spindle with the lower portion of the electrical contact mechanism.

FIG. 4*a* shows an expanded cross sectional view of the drive end of the spindle assembly 31 of FIG. 2. The spindle drive 45 engages a drive socket 47. A probe assembly 59 extends and operates downwardly through the metal sleeve 79 which has been fitted into the spindle drive 45. Attachment of the sleeve 79 to the wrench drive 81*a* can be made by press fitting, shrink fitting, tack welding or set screw connection, or any other means which would securely hold the sleeve 79 within the tool drive 45. The shield 57 can be cylindrically shaped with an inwardly projecting annular shoulder 53*a* against which a spring 96 operates. The spring 96 likewise operates against the shank of the drive 45. This causes the shield 57 to seat down on the top of the fastener 49 and remain in contact therewith, even though the tool 61 is moving as it is operated to rotate the fastener 49.

Figure 5:
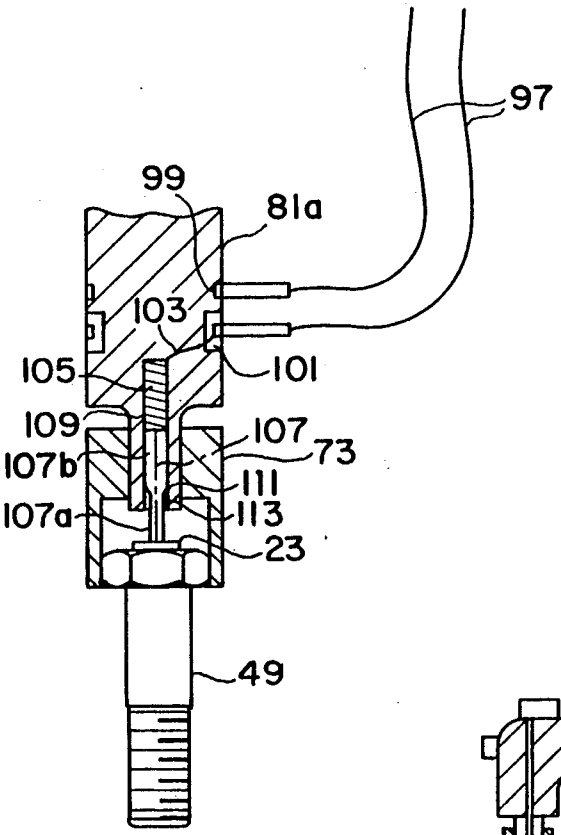
FIG. 5 shows an alternate contact mechanism for the lower drive portion of a stationary spindle.

FIG. 5 shows another means for making the electrical contact between the transducer electrical contact surface 23 of a fastener 49 and the primary electrical leads 97 to the ultrasonic drive/sense module 27. Here the ground return is connected to the body of the drive 81*a* with a first slip ring 99. This provides the "ground return" line from the transducer which has made its connection through the fastener 49 body and the drive socket 73 to the drive 81*a*.

The other or primary lead is made through a second slip ring 101 which is insulated from the drive 81*a* and connects from the second slip ring 101 through an insulated connector wire 103 to a spring 105 positioned in a bore. This spring 105 is capable of carrying electrical current. The spring 105 is positioned above a contact pin 107 and operates downwardly to bias the contact pin 107 downwardly.

The above slip ring connections could also be made with capacitive coupled connections instead of the mechanical contact slip ring design illustrated in FIG. 5.

The contact pin 107, as well as the spring 105, are situated and operate within an insulated sleeve 109, which is fixed within a cavity or bore 111 extending upwardly along the central longitudinal axis of the drive 81*a*. The pin 107 contains a smaller diameter outer end portion 107*a* and a larger diameter inner end portion 107*b*. A compression ring 113 is fitted into an annular groove in the insulated sleeve 109 for retaining the larger diameter portion of the pin 107 within the insulated sleeve 109 and thereby limiting its travel distance downwardly from the sleeve 109.

The spring bias portions of the contact mechanism embodiments shown above are shown in greater detail in FIGS. 6 and 7. The coaxial cable 37 connector, FIG. 6, being a Microdot Corp. type connector 65, seats down over a threaded portion 115*a* of a captive pin 115. The captive pin 115 is held in position within an electrical connection tube 117. This electrical connection tube 117 has an electrically conductive outer wall and an insulated inner wall against which the captive pin 115 is seated.

Positioned against the opposite end of the captive pin 115 from the coaxial cable 37 is a first spring pin subassembly 119. This first spring pin subassembly 119 can be implemented with a Coda Company probe, model type PC1C. An inner electrically conductive sleeve 121 makes an electrical connection between this first spring subassembly 119 and the lower portion of the contact mechanism.

A second spring pin subassembly 123 is seated to extend outwardly from the bottom of the conductive sleeve 121. This second spring pin subassembly 123 is biased to extend downwardly.

Coda Company type probe receptacles 120, 124 are inserted in the tube 121 to hold the upper 119 and lower 123 spring pin subassemblies, respectively. These probe receptacles, which are available in the marketplace as are the subassemblies 119, 121, are purchased by model number related to the subassemblies.

The shield 57 of FIG. 3 performs the identical function of the shield 93 of FIG. 4. This shield 57 is biased downwardly by the coil spring 95 which surrounds the outer wall of the connection tube 117 at its lower end. The connection tube 117 is securely positioned within the drive 81*a* by the socket retaining mechanism 77 which has been modified to take a probe through the drive which operates against a probe structure to secure it within the drive 81*a*.

The connection tube 117, as well as the first and second spring pin subassemblies 119, 123, are seen in greater detail in FIGS. 7 and 8*a–d*. The connection tube 117 includes an electrically conductive outer surface 127, an electrically conductive inner surface or conductor tube 121 and an insulator separator tube 129. The upper or first spring subassembly 119 is held in position by a detent 131 formed in the electrically conductive inner tube 121 at or near its upper end. The second spring pin subassembly 123 is held in position by a second detent mechanism 133 near the lower end of the conductor tube 121. This detent 133 was formed as a part of the tube 121 wall.

A Coda Company probe receptacle 124 is secured within the conductive inner tube 121. This receptacle 124 is detent pressed and soldered into the tube 121.

Figure 8C:
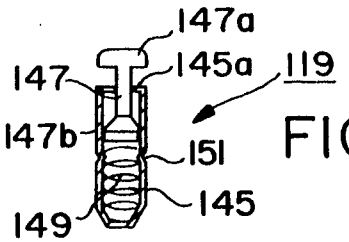
FIG. 8*c* is a cross sectional view of the upper contact pin subassembly of the contact mechanism of FIG. 7.
Figure 8D:
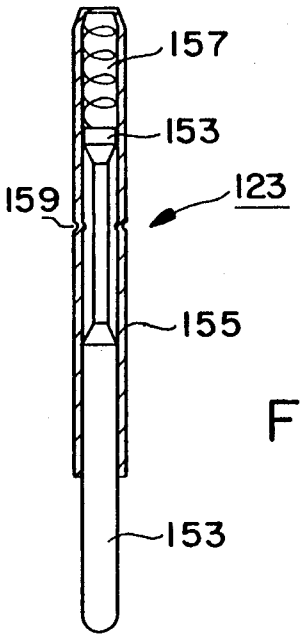
FIG. 8*d* is a cross sectional view of the lower contact pin subassembly of the contact mechanism of FIG. 7.
Figure 8B:
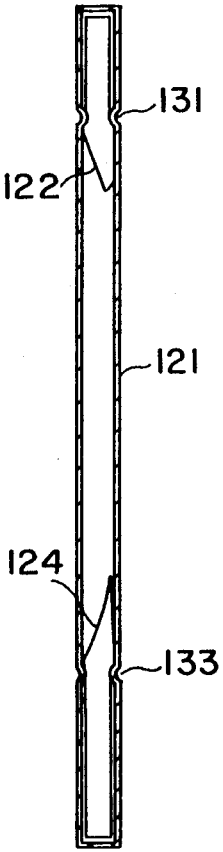
FIG. 8*b* is a cross sectional view of the conductive tubing portion of the contact mechanism of FIG. 7.
Figure 8A:
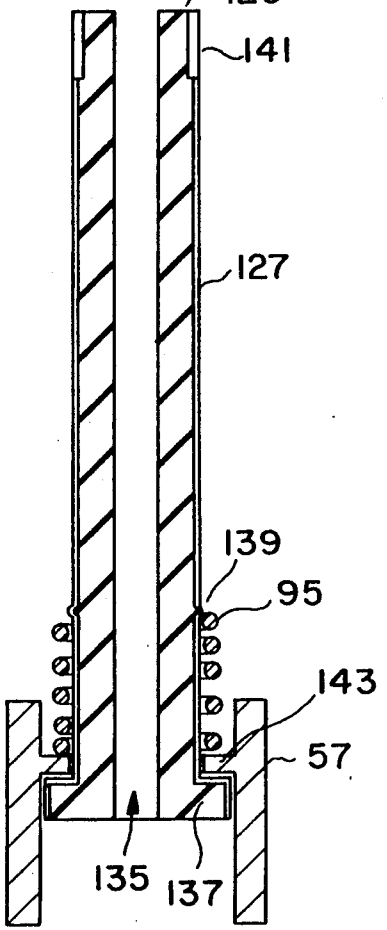
FIG. 8*a* is a detailed cross sectional view of the casing portion of the contact mechanism of FIG. 7.

The insulator separator tube 129, FIG. 8*a*, can be made of MICARTA, polyethylene or other electrical insulator material. The dimensions of this insulator separator tube 129 are appropriate to the tool in which it operates. Typically, the tube 129 is approximately 2 inches long when installed in hand wrench 61, or impact wrench 11, or spindle 31 with offset gearbox and has an outer diameter of about 0.25 inches. The inner bore 135 of this separator tube 129 is approximately 0.115 inches.

Figure 7:
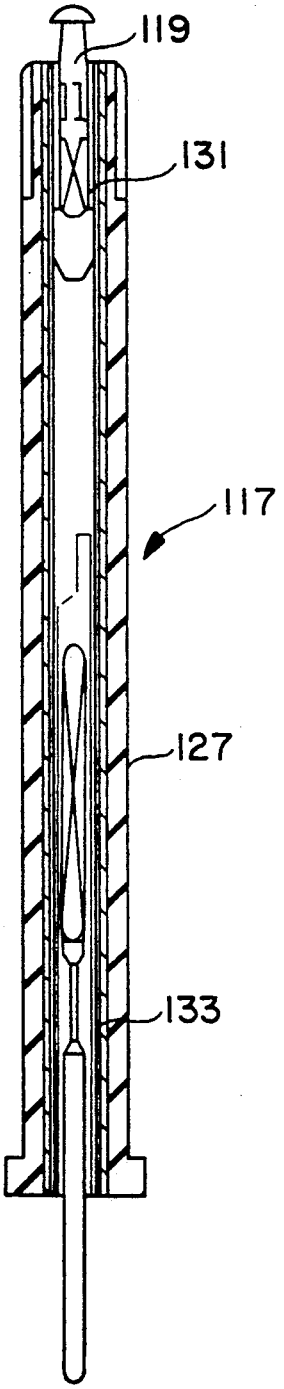
FIG. 7 shows a detailed cross section of the electrical contact mechanism of FIG. 1.
Figure 6:
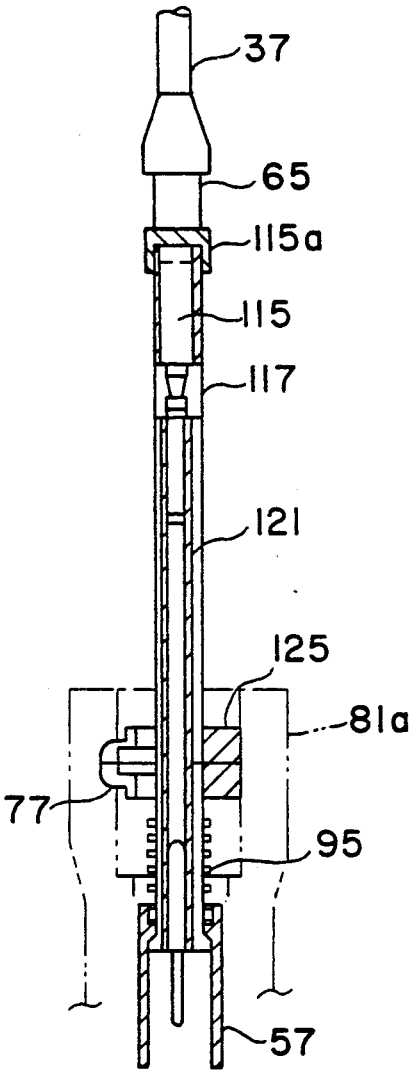
FIG. 6 is a detailed cross sectional view of the electrical contact embodiment of FIG. 3.

The bottom pin subassembly 123 is a necessary element of this contact mechanism structure, FIGS. 6 and 7. The top pin subassembly 119 could be replaced by a different type of connection means, such as those others discussed above.

An outwardly projecting annular shoulder 137 extends about the lower end of the insulator tube 129. This shoulder 137 provides a stop against which the shield 57 operates as it slides along the tube 129. This shield 57 is biased towards the shoulder 137 by the spring 95.

Shield 57 provides three functions. These include (a) an additional electrical ground return, (b) physical protection of the probe pin or contact "point" from side loads during tool positioning, and (c) protection of the probe from overtravel (axial direction) prior to bolt/fastener seating.

Spring 95 is held in position by a detent 139. In the instance where an electrically conductive outer surface 127 is created by an outer metal sleeve 127, the detent 139 can be formed on or as a part of this sleeve 127. The tubular outer sleeve 127 is formed to extend about the annular shoulder 137 of the insulator tube 129 as well. The sleeve 127 typically can be heat shrunk or glued onto the insulator tube 129.

Where no electrically conductive outer sleeve 127 is utilized, an annular groove (not shown) can be placed in the outer surface of the insulator tube 129 and at approximately the location of the detent 137. A clamp ring (not shown) can be installed in that groove for holding the spring 95 in position during assembly.

In applications where the invention is installed in a tool where the drive end would provide a surface against which the spring 95 could operate, no retention means, such as the detent 139 or a clamp ring would be needed.

The opposite end of the insulator tube 129 from the annular shoulder 137 is threaded a distance of about a quarter of an inch with 10-32 UNF threads 141. Where the electrically conductive outer surface 127 is formed by the metal sleeve, this outer tube or metal sleeve extends into the region of the threads 141.

The shield 57 forms a protective hood about the operating area for the probe pin. This shield 57 is cylindrically shaped with an inside shoulder 143 extending annularly about the inside diameter of the shield 57 at a location downwardly from the top end thereof. This shoulder 143 is positioned that distance downwardly from the top end of the shield 57 in order to engage and surround a few of the coils of the spring 95. The length of the extension shield 57 below the inside shoulder 143 is sufficient to engage the top face of a fastener when the tool in which the connection mechanism operates engages that fastener for tightening.

The electrically conductive outer surface 127 being a metal case provides a number of advantages. These include a strong electrically conductive surface against which the coil spring 95 can operate and against which the shield 57 can operate. Where the shield 57 is made of electrically conductive material, such as carbon loaded fiberglass or of metal, brass, copper or other metal, the shield 57 rests on the head of a fastener and provides an additional return path for the ultrasonic transducer signals. This path extends through the spring 95 and the sleeve 127 to connect to the shielding of the coaxial connector via the threads 141.

This is advantageous as the return path of the ultrasonic transducer signals would normally otherwise be through the drive socket engaging the fastener head. As these drive sockets often have grease and other foreign material on them, the electrical return path through the drive socket is not sufficient for a strong signal. This is especially true during high speed rundown operations before any significant tightening torque is applied to the fastener.

The use of the electrically conductive shield 57 in contact with the conductive outer case 127 provides a second return path for the ultrasonic transducer signals, thereby assuring better electronic operation of the ultrasonic drive and sense circuitry.

A hollow brass tube 121, FIG. 8*b*, forms the internal conductor tube 121. This tube 121 can be force fit into the bore 135 of the insulator separator tube 129. Typically, the brass tube 121 can have and outside diameter of approximately 0.090 inches and an inside diameter of approximately 0.074 inches.

Alternatively, the brass conductor tube 121 can be cemented within the bore 135 of the insulator separator tube 129 or can be cyrogenically inserted, i.e. inserted while in a chilled state so that it expands to firmly seat within the bore 135 as it warms to ambient temperature.

The conductor tube 121 carries the above described detents 131 and 133. These may be formed in the conductor tube 121 itself by a slight crimp or grooving of the outer wall inwardly. As an alternative, when the receptacles 122, 124 are used and are press fit or soldered into the tube 121, tube 121 need not carry the detents 131 and 133 as the receptacles 122, 124 carry their own detents for retaining the subassemblies 119, 123, respectively. They are intended to hold the first and second spring pin subassemblies 119 and 123, respectively. Typically, the upper detent 131 can be placed approximately 0.15 inches from the top end of the brass tube 121, while the bottom detent 133 can be placed approximately 0.4 inches from the bottom end of the brass tube 121.

Received within the brass tube 121 and held in position by the detent 131 is a Coda Company probe, model PC1C subassembly 119, FIG. 8*c*. This probe subassembly 119 includes an outer casing 145 with a circular probe pin 147 operating therein. This probe pin 147 has a mushroom-shaped head 147*a*. The pin 147 is biased outwardly by a small coil spring 149 operating within the casing 145. This spring 149 operates against the enlarged inner head 147*d* of the pin 147. Pin 147 is held within the casing 145 by the crimped outer end 145*a* of the casing 145 which allows passage of the reduced middle section of the pin 147 but not the enlarged inner head 147*b*. The casing 145 carries an annular groove 151 against which the detent 131 operates to hold this first spring pin subassembly 119 within the tube 121.

The second spring pin subassembly 123 is implemented with a Coda Company probe, model SSA4JS. This spring pin subassembly 123 is similar in construction to that of the first spring pin subassembly 119 except that its dimensions vary as do the dimensions of the probe pin 153 itself. This pin 153 slides within a casing 155 and is longer than the first pin 147.

This second spring pin subassembly 123 includes a small coil spring 157 operating against the closed inward end of the casing 155 and the inward enlarged head 153*a* of the probe pin 153. The case 155 carries an annular groove 159 in its outer surface for engaging the detent 133 at the lower end of the conductor tube 121.

The operating length of the first spring subassembly 119 pin 147 is approximately 0.15 inches, while the operating length of pin 153 of the second spring subassembly 123 is approximately 0.35 inches. Both subassemblies and their component parts are made of brass except for their metal springs.

The dimensions of the contact mechanisms and its component parts are chosen according to the tool environment in which they are to be operating. The first and second spring pin subassemblies 119, 123, being commercially available in the marketplace, can be replaced with other spring pin subassemblies of different dimensions, including different length pins and spring sizes for the springs 149 and 157.

A test probe, i.e., the first and second spring pin assemblies 119, 123, are of the type normally used for making electrical contacts to printed circuit boards in automated test equipment. The longer pin 153 makes contact with the top of the ultrasonic transducer contact surface 23 during tightening of the fastener carrying the ultrasonic transducer. The shorter probe (pin) 147 contacts a coaxial cable connector when assembled in a tool. The contact mechanism 17 does not rotate relative to the tightening tool during tightening of the fastener. The spring loaded pin 153 slides on the top surface of the transducer contact surface 23 as the fastener rotates. The first and second spring assemblies 119, 123 are easily removable and replaced if worn or damaged.

The shield 57 is easily replaced when worn or damaged. It slides on the head of the fastener as the tool rotates and it usually rotates with the tool and not relative thereto. However, it sometimes rotates with the head of the fastener. This rotation of absence thereof does not affect the electrical contact.

The contact mechanism 17, in any of its above described embodiments, provides an enhanced and improved electrical connection structure for making electrical connections with an ultrasonic transducer embedded in the head of a fastener. The spring force on the contact pins provide good constant electrical contact between the cable connection to the tool and the electrical contact surface 23 on the head of the bolt. The shield 57 provides an enhanced secondary return line path which assures that there is always a proper connection between the ultrasonic drive/sense module 27 and the ultrasonic transducer even when the fastener and the drive sockets 19, 47, 73 are coated with grease or dirt. The spring biasing of the contact pin, as well as the shield, assures constant contact with the respective transducer electrical contact surface 23 and the body of the fastener even during tightening where the tool may tend to bounce or vibrate thereby otherwise providing intermittent contact.

Figure 9:
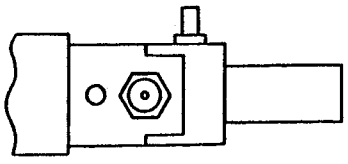
FIG. 9 is a partial cross section of a RAN (right hand nut runner tool) with an embodiment of the electrical contact mechanism in cross section.
Figure 9:
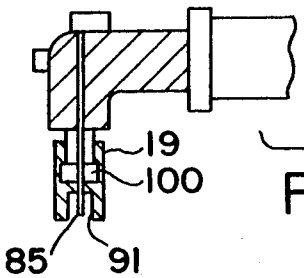

Most of the above-described tools have been slightly modified to accept the contact mechanism of the present invention. In the right hand nut runner tool 98, FIG. 9, the drive socket 19 houses the shield 91 which rides on the connector tube 85. A spring 100 seats against the drive and biases the shield 91 downwardly.

Figure 10:
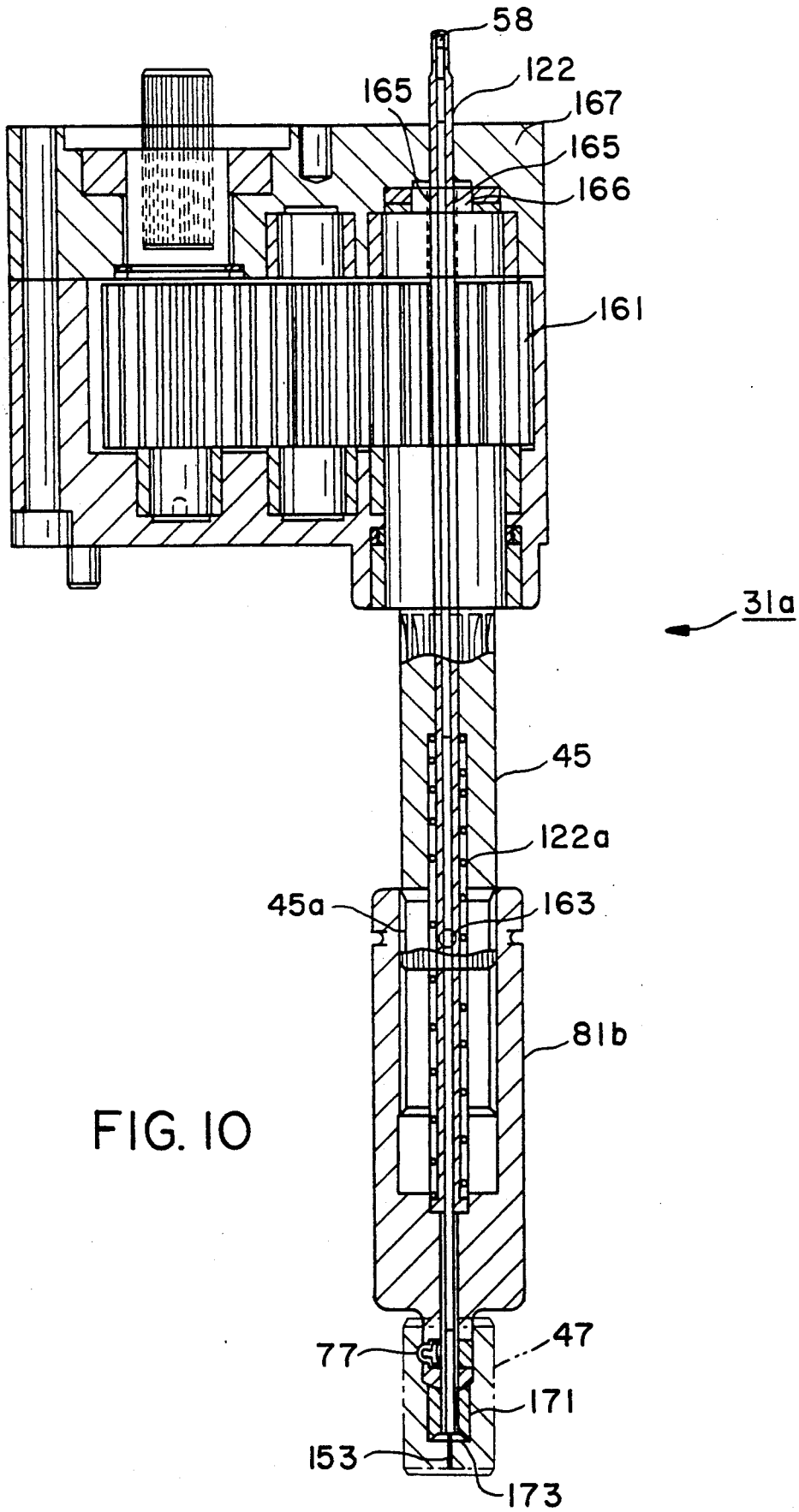
FIG. 10 is a detailed cross sectional view of the drive, spindle and drive socket portion of the offset spindle drive carrying contact mechanism.

FIG. 10 shows a detailed cross sectional view of the lower end 31*a* of an offset drive spindle tool which as been modified to receive the contact mechanism. The coaxial cable 55 of FIG. 2 is connected to an electrical fitting 58. This electrical fitting 58 is a screw type which moves with the movement of the conductor tube 122. Alternately, a flexible circuit connector can be used.

The conductor tube 122 downwardly through the drive transfer gear 161 and down the centerline of the spindle 45.

Mounted on the end of the spindle 45 is drive member 61*b*. The connection between the spindle 45 and the drive member 81*b* is a slip connection which allows a certain amount of longitudinal or vertical movement of the drive member 81*b* on the spindle 45.

The end 45*a* of the spindle 45 and the receiving socket of the drive member 81*b* both have splines to assure positive rotational movement.

A pin 163 on the splined end 45*a* of the spindle seats within a longitudinal groove in the drive 81*b* receiving socket (not shown). This pin 163 holds the two members together and the length of the groove limits the free longitudinal movement of the drive 81*b*. This movement is desirable in assembly operations as it takes up for errors in vertical positioning of the tool 31*a*.

The conductor tube 122 contains a pair of juxtaposed flat spots 165 at a location above the drive transfer gear 161 adjacent the top wall 167 of the offset gear housing. These flat spots 165 or "flats" mate with flat wall portions 166 on the bore through the top wall 167 and keep the conductor tube 122 from rotating.

The conductor tube 122 is secured to the drive 81*b* by the drive return spring 122*a*. The drive 81*b* and the drive socket 47 rotates without rotting the conductor tube 122 while fixing it to the drive with respect to vertical positioning.

The conductor tube 122 need not be a tubular sleeve, but can be an extrusion of a solid tube as discussed above with respect to FIGS. 8*a* and 8*b*.

In FIG. 10, the previously discussed shield 57 shown in FIGS. 2, 3 and 8*a* is not illustrated, but a spacer 171 which limits the working length of the socket opening within a drive socket 47 is illustrated. In embodiments where the shield 57 is utilized, this shield 57 can either be mounted from the probe pin 153, as seen in FIG. 8*a*, or mounted from the drive 81, as seen in FIG. 10. In both cases, this shield 57 is spring biased and moves relative to the probe pin 153 or drive 81. Mounting from the drive 81 is preferable for ease of replacement of the probe pin 153 during servicing.

The spacer 171 can have 4, 6, 8 or 12 "corners", as is necessary, to be received within the drive socket 47 and to rotate therewith. This spacer 171 can also be cylindrically shaped and of a size to be spaced away from the drive socket 47.

If the spacer 171 rotates with the drive socket 47, it can ride on the lower portion of the conductor tube 122. Alternatively, it can be an integral part of the drive. If the spacer 171 is free of the drive socket 47, it can be seated fast to the end of the conductor tube 122.

A small cavity or recess 173 is made in the end of the spacer 171. This allows the probe pin 153 which extends through the spacer 171 to retreat upwardly and the spacer 171 wall to take up the shock load when the entire assembly 31*a* is first lowered down on a fastener. This reduces the frequency of bent or flattened probe pins 153.

Changes can be made in the above-described invention without departing from the intent and scope thereof. It is intended, therefore, that the embodiments disclosed above are to be interpreted as illustrative of the invention and not that the invention is to be limited thereto.

What is claimed is:

1. An electrical contact mechanism for electrically connecting electronic circuitry cabling to an ultrasonic transducer which can be alternatively embedded in, permanently attached to, or temporarily attached to a fastener, said transducer providing a contact surface on said fastener, said electrical contact mechanism being positioned within a fastener tightening tool and making said electrical connection when said tightening tool is positioned on said fastener, comprising:

a first electrically isolated conduction path through said tightening tool;

a first electrical connector on a first end of said conduction path, said first electrical connector having a protruding moveable pin spring biased outwardly and being fixed so as not to rotate relative to the tool; and a second electrical conduction path through said tightening tool;

wherein said first electrical conduction path includes an outer metal casing having an electrically insulated inner bore; a rod operating within said electrically insulated inner bore; an electrical contact pin extending outwardly from one end of said rod; a boot mounted on the opposite end of said rod and extending outwardly and about said outer metal casing; and a spring mounted to operate against said boot and bias said rod and its contact pin outwardly from said insulated inner bore.

2. The mechanism of claim 1 also including an electrically conductive cylindrical shield extending about said contact pin end of said outer casing sliding thereon to be in electrical contact therewith; a biasing member mounted on said outer casing and biasing said shield in the same direction of said contact pin biasing.

3. The mechanism of claim 2 also including a housing surrounding said boot and said spring mounted to operate against said boot, said housing being in contact with said spring and providing an operating surface therefor.

4. The mechanism of claim 3 wherein said outer metal casing is in electrical contact with said housing whereby said second electrical conduction path through said tightening tool is completed.

* * * * *